US008006455B1

(12) United States Patent
Mollinger et al.

(10) Patent No.: US 8,006,455 B1
(45) Date of Patent: Aug. 30, 2011

(54) BACKED PANEL AND SYSTEM FOR CONNECTING BACKED PANELS

(75) Inventors: Paul J. Mollinger, Blacklick, OH (US); Paul R. Pelfrey, Wheelersburg, OH (US); Larry R. Fairbanks, Columbus, OH (US)

(73) Assignee: Exterior Portfolio, LLC, Atlanta, GA (US)

( * ) Notice: Subject to any disclaimer, the term of this patent is extended or adjusted under 35 U.S.C. 154(b) by 547 days.

(21) Appl. No.: 11/233,929

(22) Filed: Sep. 23, 2005

Related U.S. Application Data

(60) Provisional application No. 60/640,158, filed on Dec. 29, 2004.

(51) Int. Cl.
*E04B 1/62* (2006.01)
*E04B 1/00* (2006.01)

(52) U.S. Cl. ..... 52/519; 52/524; 52/526; 52/535; 52/539; 52/536; 52/561; 52/588.1

(58) Field of Classification Search ..... 52/518–527, 52/589.1–592.6, 529–532, 535–560, 561–572, 52/578–551
See application file for complete search history.

(56) References Cited

U.S. PATENT DOCUMENTS

| | | | | | |
|---|---|---|---|---|---|
| 1,589,675 | A | | 6/1926 | Belding | 52/522 |
| 1,728,934 | A | | 9/1929 | Hogenson | 206/322 |
| 2,085,764 | A | * | 7/1937 | Odell | 52/314 |
| 2,830,546 | A | | 4/1958 | Rippe | 108/17 |
| 2,961,804 | A | * | 11/1960 | Beckman | 52/539 |
| D196,230 | S | | 9/1963 | Raftery et al. | D13/1 |
| 3,159,943 | A | | 12/1964 | Sugar et al. | 50/200 |
| 3,233,382 | A | | 2/1966 | Graveley, Jr. | 52/522 |
| 3,246,436 | A | | 4/1966 | Roush | 52/303 |
| 3,289,365 | A | | 12/1966 | McLaughlin et al. | 52/173 |
| 3,289,380 | A | | 12/1966 | Charniga, Jr. | 52/716 |
| 3,325,952 | A | | 6/1967 | Trachtenberg | 52/276 |
| D208,251 | S | | 8/1967 | Facer | D13/1 |
| 3,387,418 | A | | 6/1968 | Tyrer | 52/242 |
| 3,399,916 | A | | 9/1968 | Ensor | 287/189.36 |
| 3,468,086 | A | * | 9/1969 | Warner | 52/173.1 |
| 3,473,274 | A | | 10/1969 | Godes | 52/127 |
| 3,520,099 | A | | 7/1970 | Mattes | 52/531 |
| 3,552,078 | A | | 1/1971 | Mattes | 52/520 |
| 3,555,762 | A | | 1/1971 | Costanzo, Jr. | 52/588 |
| 3,637,459 | A | | 1/1972 | Parish et al. | 161/161 |
| 3,703,795 | A | * | 11/1972 | Mattes | 52/521 |

(Continued)

FOREIGN PATENT DOCUMENTS

| | | |
|---|---|---|
| CA | 96829 | 8/2002 |

(Continued)

OTHER PUBLICATIONS

Sweet's General Building & Renovation, 1995 Catalog File; section 07460 on Siding, pp. 4-20.

(Continued)

*Primary Examiner* — Jeanette E. Chapman
(74) *Attorney, Agent, or Firm* — Standley Law Group LLP

(57) ABSTRACT

A backed panel comprising a facing panel and a backing panel. The backing panel has a groove, recessed portion, or any other suitable type of relief channel adapted to receive a side edge portion of a facing panel of an adjacent backed panel. By providing a space to receive a side edge portion of an adjacent facing panel, the relief channel may enable an improved lap joint to be established between adjacent backed panels.

20 Claims, 8 Drawing Sheets

U.S. PATENT DOCUMENTS

| | | | | | |
|---|---|---|---|---|---|
| 3,815,310 | A | | 6/1974 | Kessler | 52/531 |
| 3,826,054 | A | | 7/1974 | Culpepper, Jr. | 52/309 |
| 3,969,866 | A | | 7/1976 | Kyne | 52/588 |
| 3,970,502 | A | | 7/1976 | Turner | 156/310 |
| 3,973,369 | A | * | 8/1976 | Smith | 52/526 |
| 4,001,997 | A | | 1/1977 | Saltzman | 52/521 |
| 4,033,802 | A | | 7/1977 | Culpepper, Jr. et al. | 156/71 |
| 4,034,528 | A | | 7/1977 | Sanders et al. | 52/309.4 |
| 4,048,101 | A | | 9/1977 | Nakamachi et al. | |
| 4,081,939 | A | | 4/1978 | Culpepper, Jr. et al. | 52/535 |
| 4,096,011 | A | | 6/1978 | Sanders et al. | 156/196 |
| 4,102,106 | A | | 7/1978 | Golder et al. | 52/533 |
| 4,104,841 | A | | 8/1978 | Naz | 52/519 |
| 4,118,166 | A | | 10/1978 | Bartrum | 425/462 |
| 4,154,040 | A | * | 5/1979 | Pace | 52/521 |
| 4,188,762 | A | | 2/1980 | Tellman | 52/541 |
| 4,189,885 | A | | 2/1980 | Fritz | 52/287 |
| 4,272,576 | A | | 6/1981 | Britson | 428/100 |
| 4,279,106 | A | | 7/1981 | Gleason et al. | 52/100 |
| 4,319,439 | A | | 3/1982 | Gussow | 52/288 |
| 4,320,613 | A | | 3/1982 | Kaufman | 52/521 |
| 4,327,528 | A | | 5/1982 | Fritz | 52/309.1 |
| 4,389,824 | A | | 6/1983 | Anderson | 52/211 |
| 4,424,655 | A | | 1/1984 | Trostle | 52/520 |
| 4,429,503 | A | | 2/1984 | Holliday | 52/410 |
| 4,450,665 | A | | 5/1984 | Katz | 52/522 |
| D274,947 | S | | 7/1984 | Culpepper, Jr. et al. | D25/73 |
| 4,492,064 | A | | 1/1985 | Bynoe | |
| 4,506,486 | A | | 3/1985 | Culpepper, Jr. et al. | 52/529 |
| 4,593,512 | A | | 6/1986 | Funaki | 52/519 |
| 4,608,800 | A | | 9/1986 | Fredette | 52/656 |
| 4,649,008 | A | | 3/1987 | Johnstone et al. | 264/177.1 |
| 4,680,911 | A | | 7/1987 | Davis et al. | 52/521 |
| D291,249 | S | | 8/1987 | Manning | D25/73 |
| 4,694,628 | A | | 9/1987 | Vondergoltz et al. | 52/528 |
| 4,709,519 | A | | 12/1987 | Liefer et al. | 52/98 |
| 4,716,645 | A | | 1/1988 | Pittman et al. | 29/527.1 |
| 4,782,638 | A | | 11/1988 | Hovind | 52/547 |
| 4,814,413 | A | | 3/1989 | Thibaut et al. | 528/80 |
| 4,843,790 | A | | 7/1989 | Taravella | 52/211 |
| 4,856,975 | A | | 8/1989 | Gearhart | 425/131.1 |
| 4,864,788 | A | | 9/1989 | Tippmann | 52/309.8 |
| 4,911,628 | A | | 3/1990 | Heilmayr et al. | 425/131.1 |
| 4,920,709 | A | | 5/1990 | Garries et al. | 52/85 |
| 4,930,287 | A | | 6/1990 | Volk et al. | 52/748 |
| 4,962,622 | A | | 10/1990 | Albrecht et al. | 52/630 |
| 4,969,302 | A | | 11/1990 | Coggan et al. | 52/309.8 |
| D316,299 | S | | 4/1991 | Hurlburt | D25/119 |
| 5,016,415 | A | | 5/1991 | Kellis | 52/522 |
| 5,022,204 | A | | 6/1991 | Anderson | 52/211 |
| 5,022,207 | A | | 6/1991 | Hartnett | 52/537 |
| 5,024,045 | A | | 6/1991 | Fluent et al. | 53/443 |
| 5,050,357 | A | | 9/1991 | Lawson | 52/314 |
| 5,060,426 | A | * | 10/1991 | Jantzen | 52/86 |
| 5,060,444 | A | * | 10/1991 | Paquette | 52/535 |
| 5,080,950 | A | | 1/1992 | Burke | 428/81 |
| 5,090,174 | A | | 2/1992 | Fragale | 52/309.9 |
| 5,094,058 | A | * | 3/1992 | Slocum | 52/533 |
| 5,103,612 | A | | 4/1992 | Wright | 52/288 |
| 5,224,315 | A | | 7/1993 | Winter, IV | 52/309.8 |
| 5,230,377 | A | | 7/1993 | Berman | 160/327 |
| D342,579 | S | | 12/1993 | Mason | D25/119 |
| 5,282,344 | A | | 2/1994 | Moore | 52/716.8 |
| 5,303,525 | A | | 4/1994 | Magee | 52/306 |
| 5,306,548 | A | | 4/1994 | Zabrocki et al. | 428/215 |
| 5,318,737 | A | | 6/1994 | Trabert et al. | 264/171 |
| 5,347,784 | A | | 9/1994 | Crick et al. | 52/520 |
| 5,363,623 | A | | 11/1994 | King | 52/520 |
| 5,387,381 | A | | 2/1995 | Saloom | |
| 5,415,921 | A | | 5/1995 | Grohman | 428/216 |
| D361,138 | S | | 8/1995 | Moore et al. | D25/119 |
| 5,443,878 | A | | 8/1995 | Treloar et al. | 428/60 |
| 5,461,839 | A | | 10/1995 | Beck | 52/519 |
| 5,465,486 | A | | 11/1995 | King | 29/897.32 |
| 5,465,543 | A | | 11/1995 | Seifert | 52/309.8 |
| 5,475,963 | A | | 12/1995 | Chelednik | 52/545 |
| 5,482,667 | A | | 1/1996 | Dunton et al. | 264/136 |
| 5,502,940 | A | | 4/1996 | Fifield | 52/309.12 |
| 5,537,791 | A | | 7/1996 | Champagne | 52/520 |
| 5,542,222 | A | | 8/1996 | Wilson et al. | |
| 5,548,940 | A | | 8/1996 | Baldock | 53/430 |
| 5,551,204 | A | | 9/1996 | Mayrand | 52/795.1 |
| 5,560,170 | A | | 10/1996 | Ganser et al. | 52/539 |
| 5,564,246 | A | | 10/1996 | Champagne | 52/548 |
| 5,565,056 | A | | 10/1996 | Lause et al. | 156/243 |
| 5,575,127 | A | | 11/1996 | O'Neal | 52/520 |
| 5,581,970 | A | | 12/1996 | O'Shea | 52/718.01 |
| 5,586,415 | A | | 12/1996 | Fisher et al. | 52/58 |
| 5,598,677 | A | | 2/1997 | Rehm, III | 52/407.1 |
| 5,613,337 | A | | 3/1997 | Plath et al. | 52/533 |
| 5,622,020 | A | | 4/1997 | Wood | 52/546 |
| 5,634,314 | A | | 6/1997 | Champagne | 52/712 |
| 5,651,227 | A | | 7/1997 | Anderson | 52/520 |
| 5,661,939 | A | | 9/1997 | Coulis et al. | 52/519 |
| 5,662,977 | A | | 9/1997 | Spain et al. | 428/42.1 |
| 5,664,376 | A | | 9/1997 | Wilson et al. | |
| 5,671,577 | A | * | 9/1997 | Todd | 52/519 |
| 5,675,955 | A | | 10/1997 | Champagne | 52/521 |
| 5,678,367 | A | | 10/1997 | Kline | 52/211 |
| 5,694,728 | A | | 12/1997 | Heath, Jr. et al. | 52/554 |
| 5,720,114 | A | | 2/1998 | Guerin | 33/451 |
| 5,729,946 | A | | 3/1998 | Beck | 52/520 |
| 5,737,881 | A | | 4/1998 | Stocksieker | 52/90.1 |
| 5,765,333 | A | | 6/1998 | Cunningham | 52/481.1 |
| 5,768,844 | A | | 6/1998 | Grace, Sr. et al. | 52/529 |
| 5,784,848 | A | * | 7/1998 | Toscano | 52/519 |
| 5,791,093 | A | | 8/1998 | Diamond | 52/36.5 |
| 5,806,185 | A | | 9/1998 | King | 29/897.32 |
| 5,809,731 | A | | 9/1998 | Reiss | 52/533 |
| 5,829,206 | A | | 11/1998 | Bachman | 52/94 |
| 5,836,113 | A | | 11/1998 | Bachman | 52/94 |
| D402,770 | S | | 12/1998 | Hendrickson et al. | D25/141 |
| 5,857,303 | A | | 1/1999 | Beck et al. | 52/520 |
| 5,858,522 | A | | 1/1999 | Turk et al. | |
| 5,866,054 | A | | 2/1999 | Dorchester et al. | |
| 5,866,639 | A | | 2/1999 | Dorchester et al. | 523/171 |
| 5,869,176 | A | | 2/1999 | Dorchester et al. | |
| 5,878,543 | A | | 3/1999 | Mowery | 52/519 |
| 5,946,876 | A | | 9/1999 | Grace, Sr. et al. | 52/520 |
| 5,956,914 | A | | 9/1999 | Williamson | 52/520 |
| 5,974,756 | A | | 11/1999 | Alvarez et al. | 52/553 |
| 6,029,415 | A | | 2/2000 | Culpepper et al. | 52/522 |
| 6,035,587 | A | | 3/2000 | Dressler | 52/97 |
| 6,047,507 | A | | 4/2000 | Lappin et al. | 52/212 |
| 6,050,041 | A | | 4/2000 | Mowery et al. | 52/520 |
| 6,086,997 | A | | 7/2000 | Patel et al. | 428/355 BL |
| D429,009 | S | | 8/2000 | Ginzel | D25/136 |
| 6,122,877 | A | | 9/2000 | Hendrickson et al. | 52/520 |
| 6,161,354 | A | | 12/2000 | Gilbert et al. | 52/520 |
| 6,187,424 | B1 | | 2/2001 | Kjellqvist et al. | 428/220 |
| 6,195,952 | B1 | | 3/2001 | Culpepper et al. | 52/522 |
| 6,223,488 | B1 | | 5/2001 | Pelfrey et al. | 52/302.1 |
| 6,233,890 | B1 | | 5/2001 | Tonyan | |
| 6,263,574 | B1 | | 7/2001 | Lubker, II et al. | 29/897.32 |
| 6,272,797 | B1 | | 8/2001 | Finger | 52/94 |
| D447,820 | S | | 9/2001 | Grace | D25/119 |
| 6,282,858 | B1 | | 9/2001 | Swick | 52/533 |
| D448,865 | S | | 10/2001 | Manning | D25/141 |
| 6,295,777 | B1 | | 10/2001 | Hunter et al. | 52/519 |
| D450,138 | S | | 11/2001 | Barber | D25/141 |
| 6,321,500 | B1 | | 11/2001 | Manning et al. | 52/555 |
| 6,336,988 | B1 | | 1/2002 | Enlow et al. | 156/238 |
| 6,348,512 | B1 | | 2/2002 | Adriani | 521/85 |
| D454,962 | S | | 3/2002 | Grace | D25/119 |
| 6,358,585 | B1 | | 3/2002 | Wolff | 428/36.6 |
| 6,360,508 | B1 | | 3/2002 | Pelfrey et al. | 52/520 |
| 6,363,676 | B1 | | 4/2002 | Martion, III | 52/519 |
| 6,367,220 | B1 | | 4/2002 | Krause et al. | 52/512 |
| 6,393,792 | B1 | | 5/2002 | Mowery et al. | |
| 6,442,912 | B1 | | 9/2002 | Phillips et al. | 52/741.4 |
| 6,516,577 | B2 | | 2/2003 | Pelfrey et al. | 52/302.1 |
| D471,292 | S | | 3/2003 | Barber | D25/141 |
| 6,526,718 | B2 | | 3/2003 | Manning et al. | 52/555 |
| 6,539,675 | B1 | | 4/2003 | Gile | 52/96 |
| 6,594,965 | B2 | | 7/2003 | Coulton | 52/302.1 |
| 6,625,939 | B1 | | 9/2003 | Beck et al. | 52/105 |
| D481,804 | S | | 11/2003 | Pelfrey | D25/119 |

| | | | | |
|---|---|---|---|---|
| 6,673,868 | B2 | 1/2004 | Choulet | 525/70 |
| 6,716,522 | B2 | 4/2004 | Matsumoto et al. | |
| 6,752,941 | B2 | 6/2004 | Hills | |
| 6,784,230 | B1 | 8/2004 | Patterson et al. | 524/13 |
| 6,865,849 | B1 | 3/2005 | Mollinger et al. | 52/96 |
| 6,886,301 | B2 | 5/2005 | Schilger | 52/302.1 |
| 7,040,067 | B2 * | 5/2006 | Mowery et al. | 52/519 |
| 7,188,454 | B2 * | 3/2007 | Mowery et al. | 52/539 |
| 7,281,358 | B2 * | 10/2007 | Floyd | 52/518 |
| 7,331,150 | B2 * | 2/2008 | Martinique | 52/520 |
| 7,467,500 | B2 | 12/2008 | Fairbanks et al. | |
| 2001/0041256 | A1 | 11/2001 | Heilmayr | 428/318.6 |
| 2002/0018907 | A1 | 2/2002 | Zehner | 428/537.1 |
| 2002/0020125 | A1 | 2/2002 | Pelfrey et al. | 52/302.1 |
| 2002/0025420 | A1 | 2/2002 | Wanat et al. | 428/213 |
| 2002/0029537 | A1 | 3/2002 | Manning et al. | 52/518 |
| 2002/0054996 | A1 | 5/2002 | Rheenen | 428/420 |
| 2002/0056244 | A1 | 5/2002 | Hertweck | 52/520 |
| 2002/0076544 | A1 | 6/2002 | DeWorth et al. | 428/317.1 |
| 2002/0078650 | A1 | 6/2002 | Bullinger et al. | 52/539 |
| 2002/0090471 | A1 | 7/2002 | Burger et al. | 428/15 |
| 2002/0108327 | A1 | 8/2002 | Shaw | 52/211 |
| 2002/0177658 | A1 | 11/2002 | Tajima et al. | 525/85 |
| 2003/0014936 | A1 | 1/2003 | Watanabe | 52/518 |
| 2003/0056458 | A1 | 3/2003 | Black et al. | 52/541 |
| 2003/0131551 | A1 | 7/2003 | Mollinger et al. | 52/518 |
| 2003/0154664 | A1 | 8/2003 | Beck et al. | 52/105 |
| 2004/0003566 | A1 | 1/2004 | Sicuranza | 52/518 |
| 2004/0026021 | A1 | 2/2004 | Groh et al. | 156/244.12 |
| 2004/0142157 | A1 | 7/2004 | Melkonian | 428/292.1 |
| 2004/0211141 | A1 | 10/2004 | Sandy | 52/506.01 |
| 2005/0081468 | A1 | 4/2005 | Wilson et al. | |
| 2006/0053740 | A1 | 3/2006 | Wilson et al. | |

FOREIGN PATENT DOCUMENTS

| | | | |
|---|---|---|---|
| CA | 2267000 | | 4/2003 |
| CL | 3.856 | | 5/2001 |
| DE | 4 01 04 760.1 | | 5/2001 |
| EP | 1086 988 | A1 | 3/2001 |
| GB | 1068202 | | 5/1967 |
| GB | 2101944 | | 8/2001 |
| JP | 364001539 | A | 1/1989 |
| JP | 09141752 | A | 6/1997 |
| JP | 410018555 | A | 1/1998 |
| JP | 02001079951 | A | 3/2001 |
| KR | 321694 | | 3/2003 |
| PL | 4115 | | 7/2004 |
| WO | WO 00/55446 | | 9/2000 |

OTHER PUBLICATIONS

Web site print outs from www.dupontdow.com, "Adhesives," Aug. 12, 2000, 3 pages.

Web site print outs from www.dupontdow.com, "Neoprene—Grades of Neoprene—AquaStik™ Water Based Polychloroprene." Aug. 12, 2000, 2 pages.

Web site print outs from www.dupontdow.com, "Neoprene—Grades of Neoprene—Neoprene Solid Grades for Solvent-Based Adhesives." Aug. 12, 2000, 2 pages.

"New Craneboard sold core siding redefines home exterior siding," Crane Performance Siding news release online, Mar. 20, 2001, 3 pages.

Jim Weiker, "Crane puts new face on siding," The Columbus Dispatch, May 9, 2002, 3 pages.

Innovations for Living, "What Do I Look for in Quality Vinyl Siding?" Owens Corning, Nov. 9, 2002, 1 page.

Crane in the News, International Builders' Show Preview, Jan./Feb. 2003, 1 page.

Mark Feirer, "Vinyl Siding, Love it or hate it, plastic is here to stay," This Old House Online, no date, 8 pages.

* cited by examiner

BACKED PANEL AND SYSTEM FOR CONNECTING BACKED PANELS

This application claims the benefit of U.S. Provisional Application No. 60/640,158, filed Dec. 29, 2004, which is incorporated by reference in its entirety.

BACKGROUND AND SUMMARY OF THE INVENTION

The present invention relates generally to panels and, more particularly, to a backed panel and a backed panel assembly. Examples of panels that may benefit from the present invention include siding panels, wall panels, and other similar, suitable, or conventional types of panels or components. U.S. Pat. No. 6,321,500 is hereby incorporated by reference as just one example of a panel that may benefit from the present invention. Although the present invention may be described herein primarily with regard to siding panels and wall panels, it is not intended to limit the present invention to any particular type of panel or component, unless expressly claimed otherwise.

In order to enhance the thermal insulation of building structures, one or more layers or panels of insulating material may be provided between a facing panel and a building structure. Known insulated siding systems exist in many different forms. A common problem with known insulated siding systems is the joint between the sides of adjacent siding units. Simply abutting siding units that are situated side-by-side may leave an unsightly gap that may be infiltrated by wind, rain, and insects. On the other hand, overlapping the siding panels of adjacent backed siding units may result in an uneven or raised seam as a result of the presence of the backing panels. A raised or uneven seam may also detract from the appearance of the siding and create a passage for the undesired transfer of air, moisture, and insects. In addition, a raised or uneven seam may increase the risk of oil canning of the siding panels as well as delamination of the siding units. Furthermore, overlapping the siding panels may cause breakage or other damage to the underlying backing panel, which compromises the functionality of the backing panel. Thus, to achieve the desired level of integration between adjoined backed paneling units, an improved system and method of forming a lapped joint between backed panels without interference of the backing panels is needed.

The present invention provides a backed panel and a system for connecting backed panels. An exemplary embodiment of the backed panel comprises a facing panel and a backing panel, wherein the backing panel has a groove, recessed portion, or any other suitable type of relief channel. An exemplary embodiment of the relief channel may be adapted to receive a side edge portion of a facing panel of an adjacent backed panel. By providing a space to receive a side edge portion of an adjacent facing panel, an exemplary embodiment of the present invention may enable an improved lap joint to be established between adjacent backed panels.

In addition to the novel features and advantages mentioned above, other features and advantages of the present invention will be readily apparent from the following descriptions of the drawings and exemplary embodiments.

DETAILED DESCRIPTION OF EXEMPLARY EMBODIMENT(S)

Figure 1:
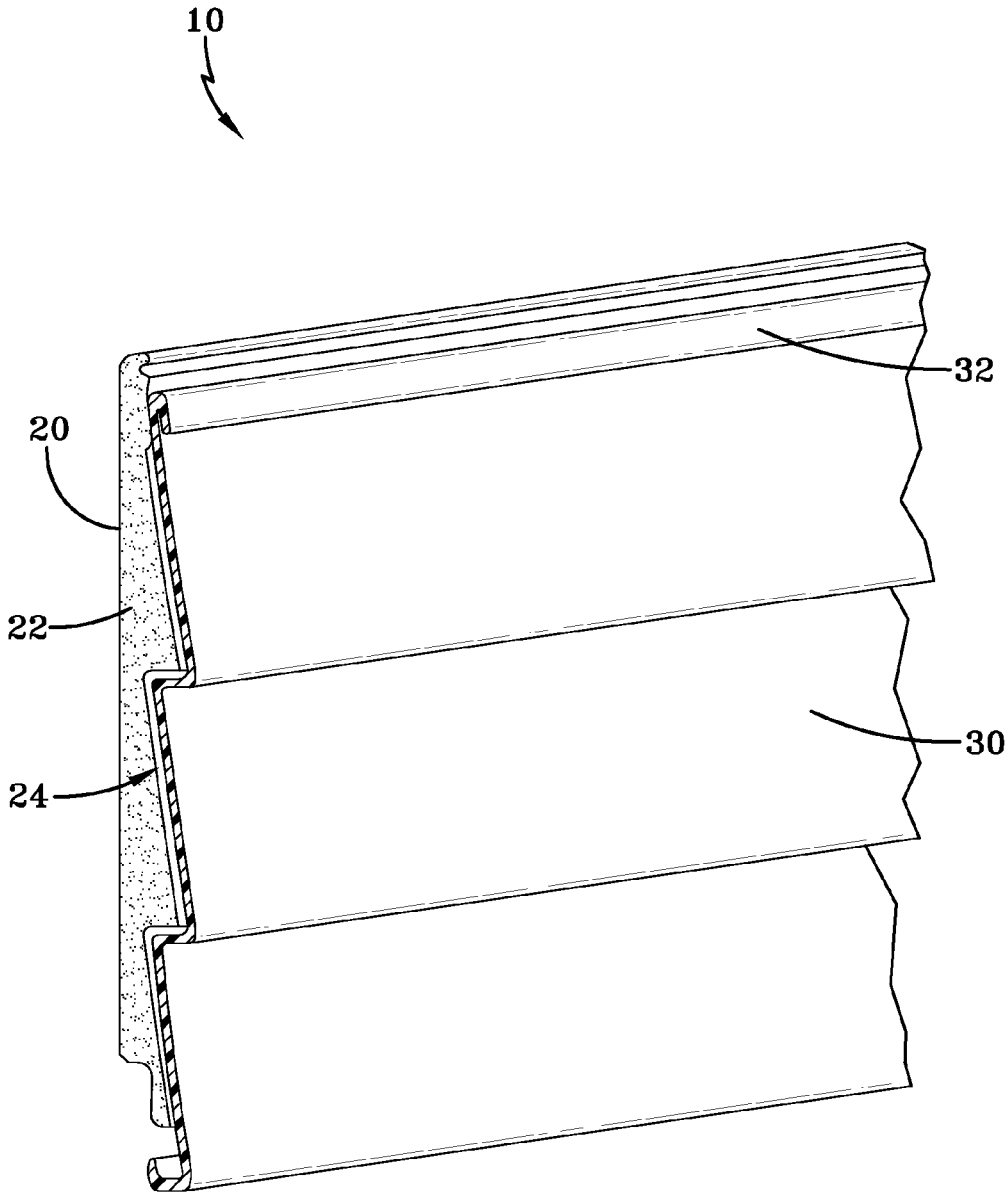
FIG. 1 is a partial perspective view of an exemplary embodiment of a backed panel of the present invention.

The present invention is directed to a backed paneling unit. In FIG. 1, an exemplary embodiment of a backed paneling unit 10 (e.g., a siding unit) includes backing panel or portion 20 and facing panel or portion 30 (e.g., a siding panel), which may optionally have an attachment flange 32. Side edge portion 22 of backing panel 20 includes a relief channel 24. Relief channel 24 may be a groove, channel, or any other suitable type of recessed portion. In particular, relief channel 24 is adapted to provide a gap or space between backing panel 20 and siding panel 30 for receiving a side edge portion of a siding panel of an adjacent siding unit. As a result, an exemplary embodiment of the present invention may enable the formation of an improved lap between adjacent backed paneling units.

Figure 2:
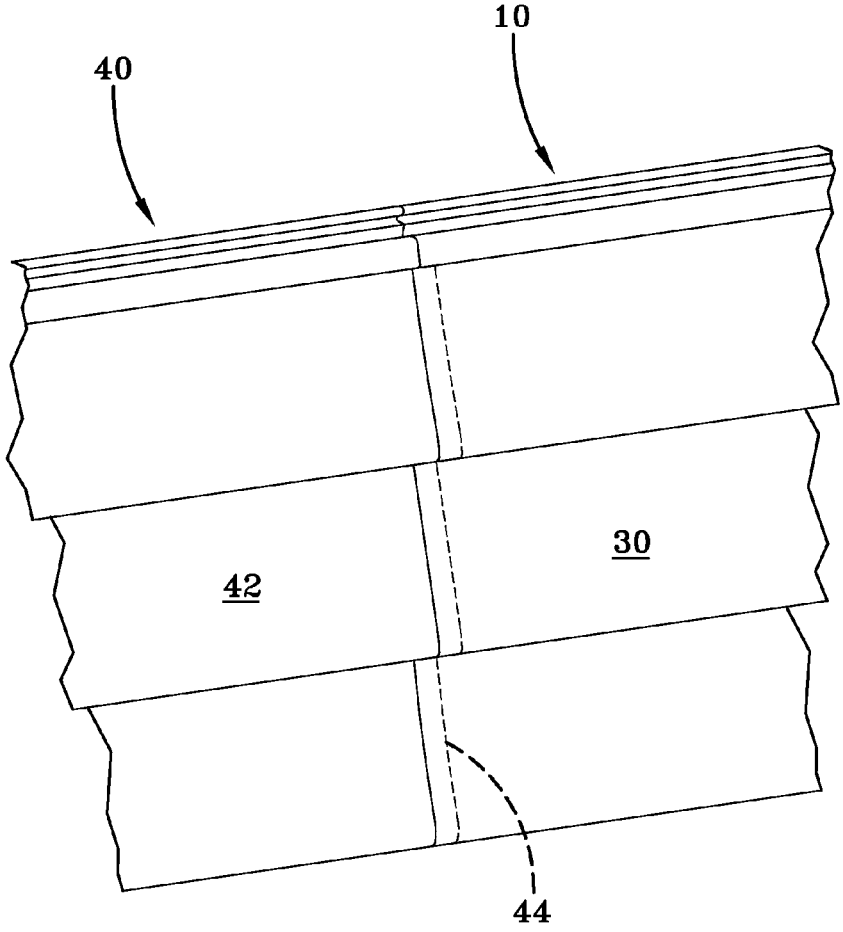
FIG. 2 is a partial perspective view of a panel assembly including the backed panel of FIG. 1.

FIG. 2 shows an example of an assembly including siding unit 10 of FIG. 1. In this example, a lap joint is formed between siding unit 10 and siding unit 40. In particular, a side edge portion 44 of siding panel 42 of siding unit 40 is inserted into the gap between backing panel 20 and siding panel 30 that is provided by relief channel 24. Side edge portion 44 of siding panel 42 is shown in phantom because it is overlapped by siding panel 30.

Due to relief channel 24, an exemplary embodiment of the present invention may enable the formation of an improved seam between backed panels that are located side-by-side. For instance, an exemplary embodiment of the present invention may enable the seam to be significantly smoother as compared to a backed panel system that does not include a relief channel in a backing panel. In other words, displacement of siding panel 30 by side edge portion 44 may be minimized because of relief channel 24. Thus, in addition to providing a seam that may be resistant to water, air, and insect infiltration, an exemplary embodiment of the present invention may enable the formation of a seam that may improve the appearance of a siding assembly and may also mitigate delamination and oil canning of a siding unit. Furthermore, relief channel 24 may also limit damage to backing panel 20. In particular, relief channel 24 creates a gap that facilitates the insertion of side edge portion 44 under siding panel 30 without damaging backing panel 20.

Backing panel 20 may be comprised of any suitable material. For example, backing panel 20 may be comprised of a foamed plastic (e.g., expanded or extruded polystyrene foam, polyurethane foam, or any other desired plastic foam material) or any other similar or suitable reinforcing or insulating material. In fact, it should be recognized that backing panel 20 may be comprised of any material having desired physical characteristics including, but not limited to, foam, fiberglass, cardboard, and other similar or suitable materials. Any suitable means may be used to obtain the shape of backing panel 20. In an exemplary embodiment, the shape of backing panel 20 may be obtained by molding (e.g., compression molding, injection molding, vacuum molding, or other similar or suitable types of molding), by extrusion through a predetermined die configuration, by cutting or machining such as with a power saw or other cutting devices, and/or by any other suitable method.

Siding panel 30 may be comprised of any suitable material. An exemplary embodiment of siding panel 30 may be formed from a polymer such as a vinyl material. Other materials such as polypropylene, polyethylene, other plastics and polymers, polymer composites (such as polymer reinforced with fibers or other particles of glass, graphite, wood, flax, other cellulosic materials, or other inorganic or organic materials), metals (such as aluminum or polymer coated metal), or other similar or suitable materials may also be used. The panel may be molded, extruded, roll-formed from a flat sheet, or formed by any other suitable manufacturing technique.

Backing panel 20, which may, for example, be used for panel stiffness, reinforcement, thermal insulation, noise mitigation, or reduction of oil canning, may be attached to the backside of siding panel 30. Attachment of the backing panel 20 to the siding panel 30 may be achieved using any desired attachment material. Examples of attachment materials include adhesives, glues, epoxies, polymers, tapes (pressure sensitive adhesive tapes), VELCRO, other hook and loop fastening materials, and other similar or suitable attachment materials. For example, an adhesive may be used to bond a portion of backing panel 20 to a portion of the inside of siding panel 30. In one exemplary embodiment, the attachment material may be flexible such that it may help to compensate for the expansion and contraction forces between backing panel 20 and siding panel 30, which may expand and contract at different rates.

Figure 3:
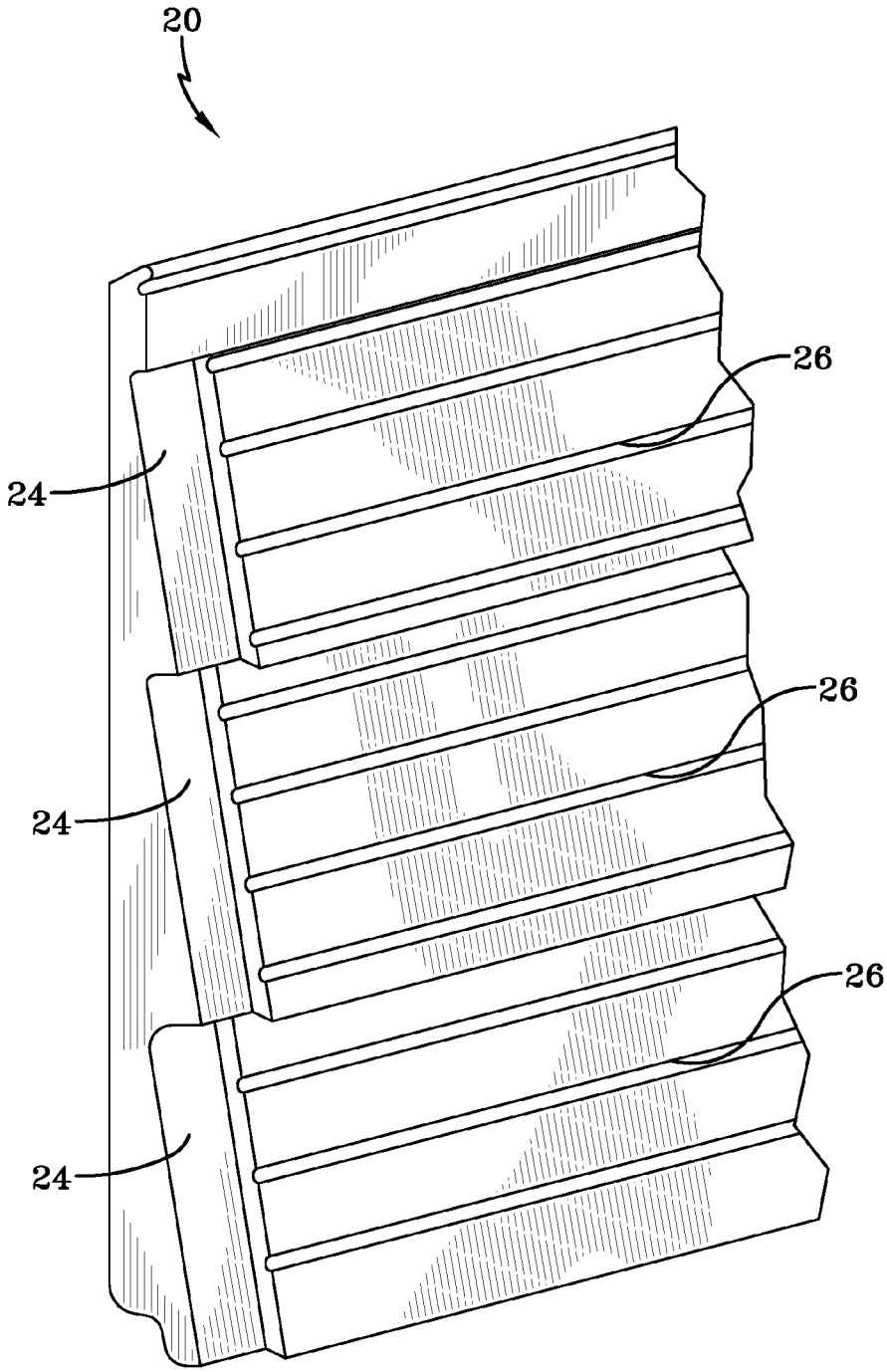
FIG. 3 is a partial perspective view of the backing panel of FIG. 1.

Optionally, such as shown in FIG. 3, backing panel 20 may include grooves 26 to enhance attachment of backing panel 20 to siding panel 30. Grooves 26 may provide space between backing panel 20 and siding panel 30 to accept and retain a desired quantity of an attachment material to promote attachment. Grooves 26 may be machined, extruded, molded, or imparted into backing panel 20 by any suitable method and in any desired direction(s). For example, grooves 26 may be selectively positioned to provide direction for optimal placement of the attachment material for attaching backing panel 20 to siding panel 30. In this example, grooves 26 extend in a generally horizontal direction substantially across the entire length of backing panel 20 to account for forces in the longitudinal direction of siding unit 10 caused by the different expansion and contraction properties of backing panel 20 and siding panel 30. Although grooves 26 stop at relief channel 24 in this example, grooves 26 may optionally extend through relief channel 24. Other variations are also possible. For example, in other exemplary embodiments of the present invention, grooves 26 may: only extend a limited distance; extend in a vertical, diagonal, or other desired direction; have a winding or other curvy shape; intersect with at least one other recess; and/or extend along any other desired direction.

Figure 4:
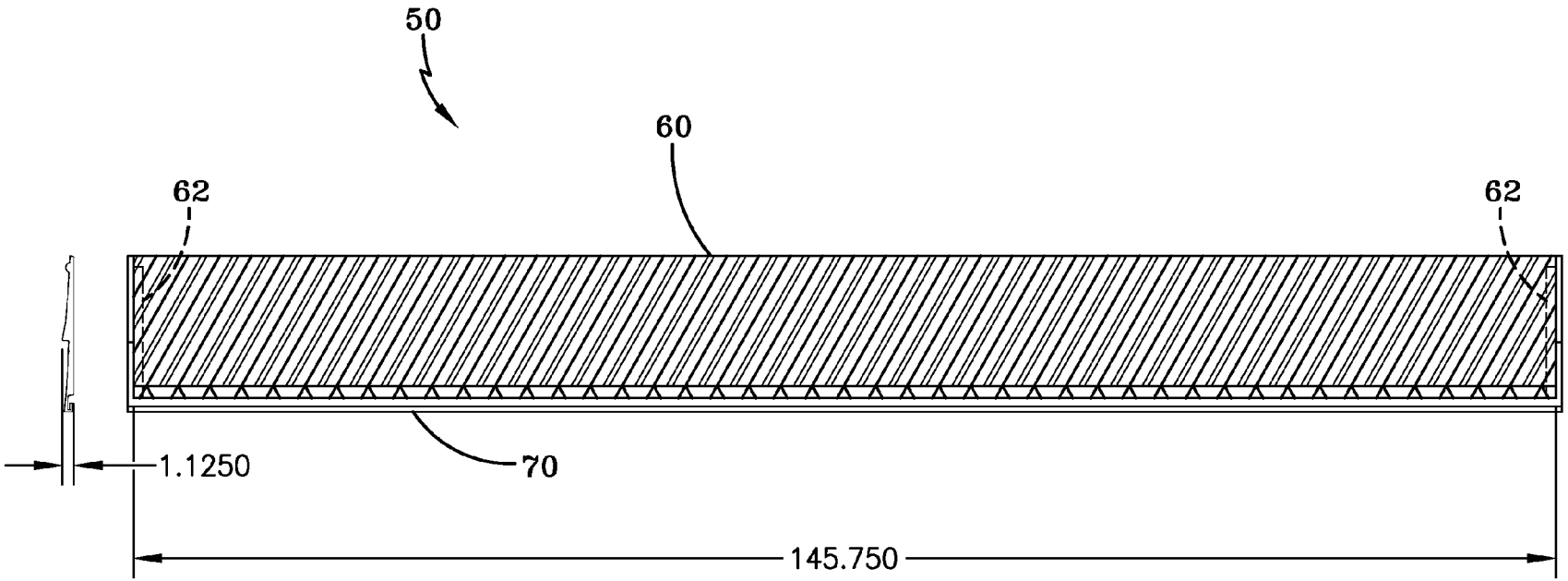
FIG. 4 is a rear elevation view of an exemplary embodiment of a backed panel of the present invention (approximate dimensions are given for the purpose of example only).
Figure 5:
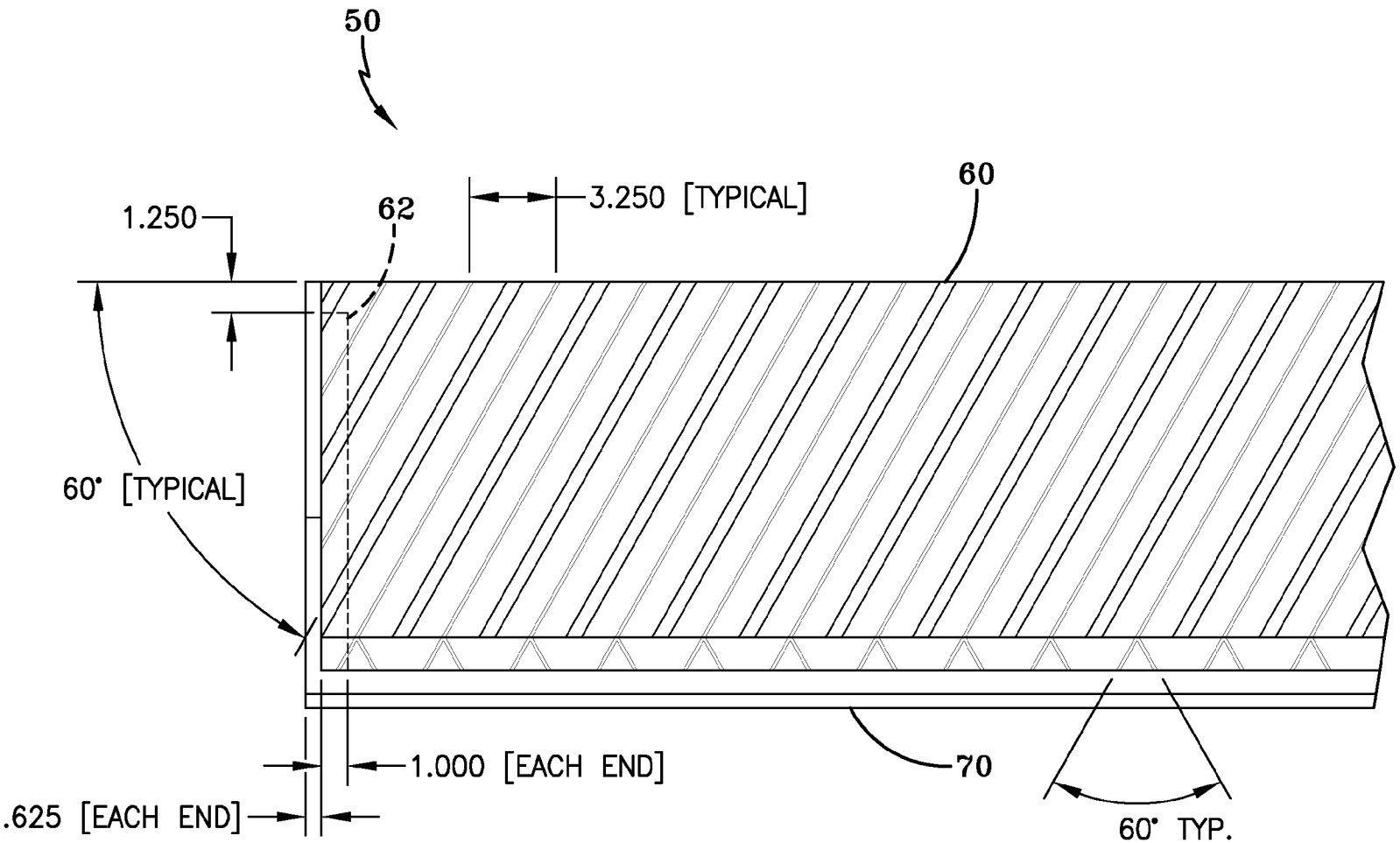
FIG. 5 is a partial rear elevation view of the backed panel of FIG. 4 (approximate dimensions are given for the purpose of example only).
Figure 6A:
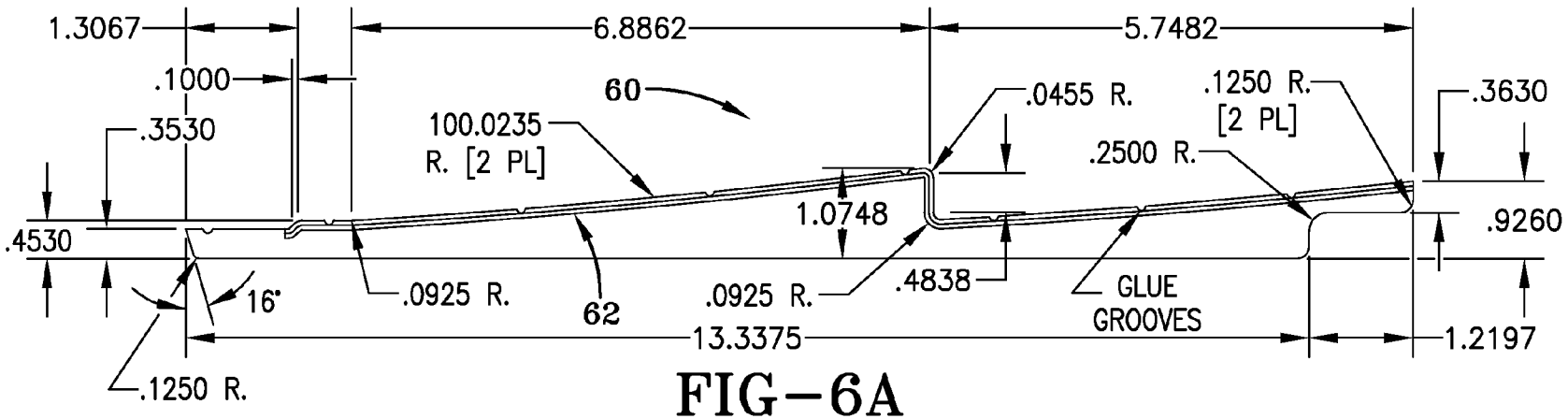
FIG. 6A is a side elevation view of the backing panel of FIG. 4 (approximate dimensions are given for the purpose of example only).
Figure 6B:
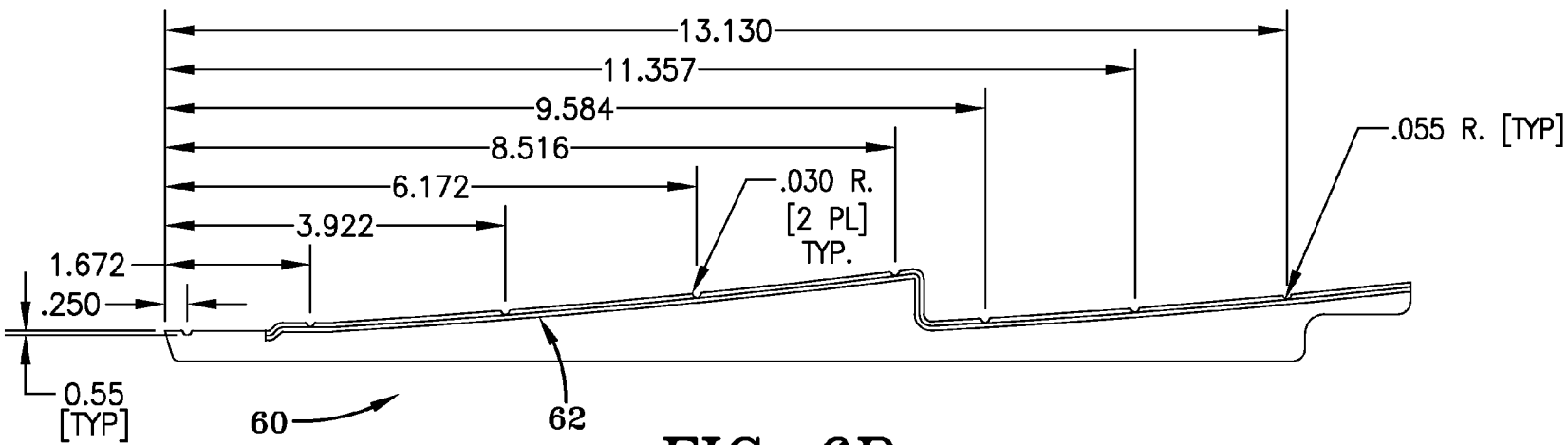
FIG. 6B is another side elevation view of the backing panel of FIG. 4 (approximate dimensions are given for the purpose of example only).

Referring now to the example shown in FIGS. 4 and 5, siding unit 50 is comprised of a backing panel 60 and a siding panel 70. Relief channels 62, which are shown in phantom, are provided on opposing side edge portions of backing panel 60 in this exemplary embodiment. However, in other exemplary embodiments of the present invention, a relief channel may optionally be provided on only one side edge portion. A relief channel 62 may extend along any desired portion of a side edge portion of backing panel 60. In this example, a relief channel may extend from the bottom of backing panel 60 up to a point approximately where backing panel 60 is proximate to an attachment flange of siding panel 70. FIG. 1 shows another example of this type of configuration. Nevertheless, it should be recognized that a relief channel of other exemplary embodiments may extend along a different portion of the side edge portion or along the entire side edge portion of the backing panel.

A relief channel 62 may have any suitable dimensions that enable it to receive an adjacent siding panel. In FIGS. 4 and 5, the dimensions, which are in inches, are provided merely as an example of one embodiment of the present invention. FIG. 5 is a detail of FIG. 4 showing exemplary dimensions of a relief channel 62. Optionally, such as shown in FIG. 5, backing panel 60 may be offset from the side edge of siding panel 70, which may also facilitate the formation of a lap joint with an adjacent siding unit. In this example, the offset may be about 0.625 inch. Nevertheless, it should be recognized that the optional offset may be any suitable or desired distance. Furthermore, as shown in FIG. 5, a relief channel 62 in this example may have a depth of about 1.0 inch. However, it should again be recognized that any suitable depth may be selected for relief channel 62 to enable it to receive an adjacent siding panel.

Figure 7:
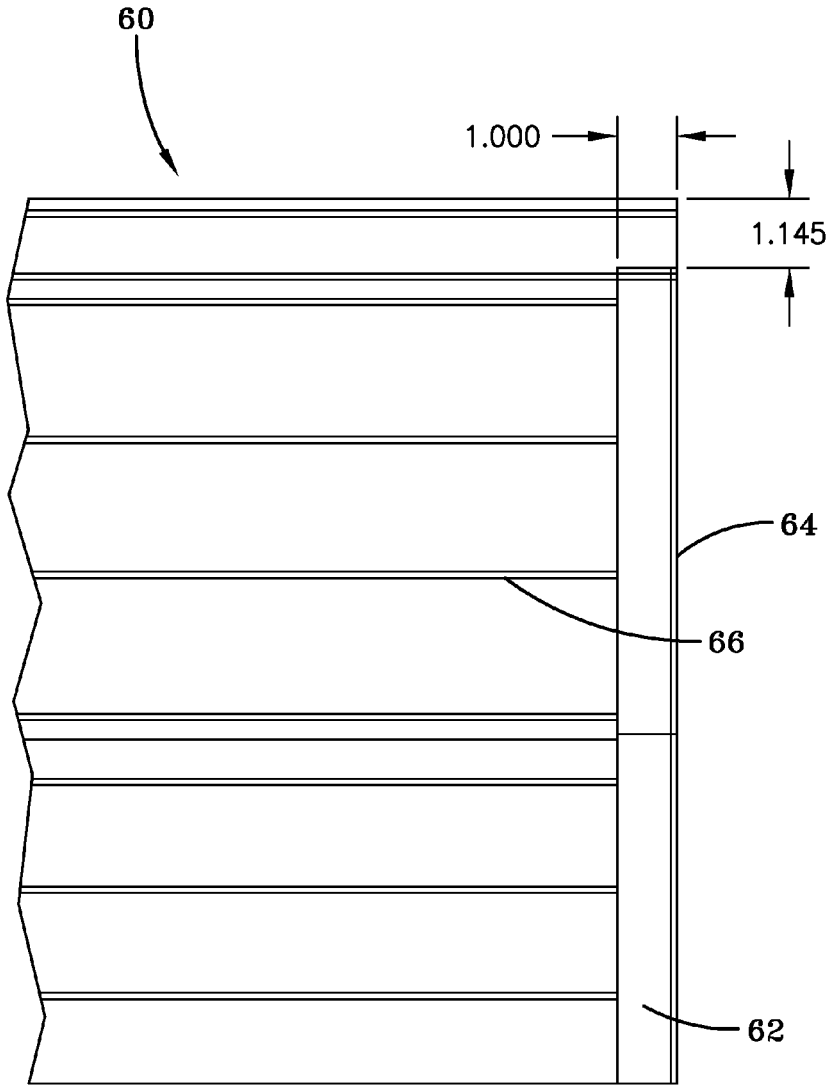
FIG. 7 is a partial front elevation view of the backing panel of FIG. 4 (approximate dimensions are given for the purpose of example only).
Figure 8:
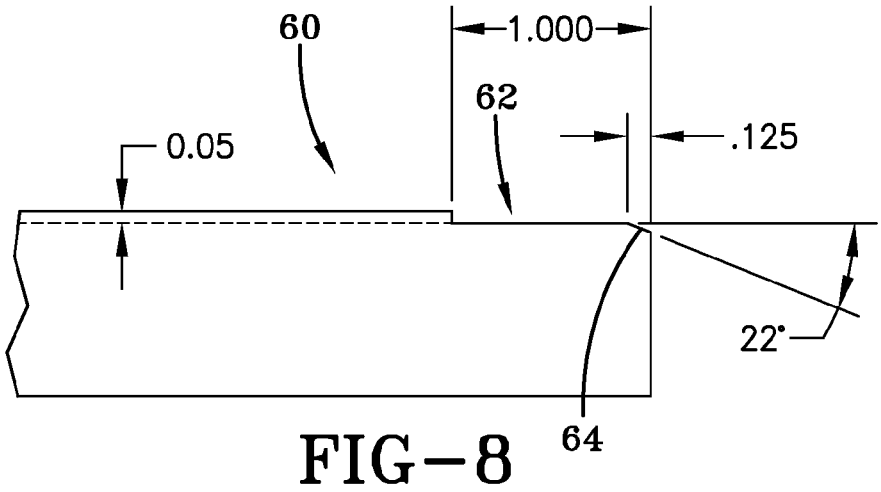
FIG. 8 is a partial bottom plan view of the backing panel of FIG. 4 (approximate dimensions are given for the purpose of example only).
Figure 9:
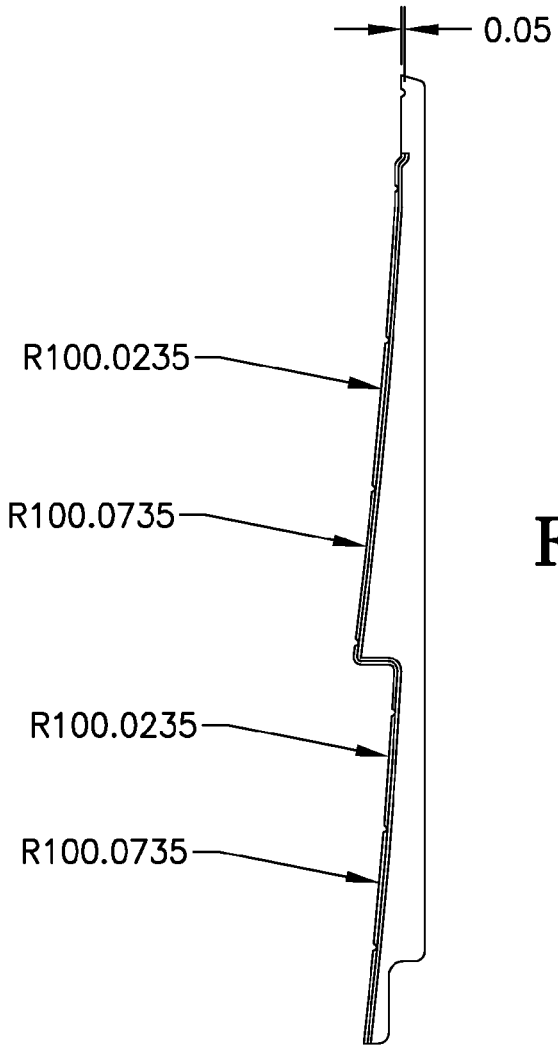
FIG. 9 is another side elevation view of the backing panel of FIG. 4 (approximate dimensions are given for the purpose of example only).

FIGS. 6A, 6B, 7, 8, and 9 illustrate further exemplary dimensions for backing panel 60. Again, it should be recognized that such dimensions are provided for illustrative purposes only and are not intended to limit the invention unless expressly claimed otherwise. FIG. 7 shows that relief channel 62 starts about 1.145 inches from the top edge of backing panel 60 in this exemplary embodiment. In addition, FIGS. 7 and 8 more clearly show the approximate 1.0-inch depth of relief channel 62 of this example, and FIGS. 8 and 9 show that the approximate width of this exemplary embodiment of relief channel 62 is about 0.05 inch. As shown in FIGS. 7 and 8, relief channel 62 may have a chamfer 64 along any portion of its side edge. In this example, chamfer 64 extends along the entire side edge of relief channel 62. Chamfer 64 may facilitate the insertion of an adjacent siding panel into relief channel 62. In addition, chamfer 64 may also help to limit damage to the side edge of relief channel 62, which could be caused the insertion of an adjacent siding panel into relief channel 62. A chamfer may have any suitable dimensions. In this example, chamfer 64 has a depth of about 0.125 inch, and it extends at about a 22-degree angle from the primary surface of relief channel 62. Other dimensions for chamfer 64 are possible and considered within the scope of the present invention. Backing panel 60 may also include optional grooves 66 such as shown in FIG. 7, which may provide space between backing panel 60 and siding panel 70 to accept and retain a desired quantity of an attachment material to promote attachment of backing panel 60 to siding panel 70. As shown in FIGS. 8 and 9, the profile of this exemplary embodiment backing panel 60 may have a slight radius curvature of about 100.0235 inches, whereas the radius curvature of relief channel 62 may be about 100.0735 in this example. The radius curvature of a backing panel and relief channel of the present invention may be selected to obtain the desired aesthetic, physical, and performance characteristics of the backing panel and overall siding unit.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A paneling unit comprising:

a siding portion; and a backing portion secured to said siding portion, a surface of a side edge portion of said backing portion opposite an underside of said siding portion having a relief channel such that a gap is provided between said underside of said siding portion and said surface of said side edge portion of said backing portion;

wherein said relief channel is adapted to receive a side edge portion of a siding portion of an adjacent paneling unit when installed such that said side edge portion of said siding portion of said adjacent paneling unit is situated between said underside of said siding portion of said paneling unit and said surface of said side edge portion of said backing portion of said paneling unit.

2. The paneling unit of claim 1 wherein said backing portion is comprised of a foamed plastic.

3. The paneling unit of claim 1 wherein said siding portion is a vinyl siding panel.

4. The paneling unit of claim 1 wherein said siding portion is comprised of a plastic composite including cellulosic filler.

5. The paneling unit of claim 1 wherein said relief channel is formed by a method selected from the group consisting of machining, extruding, and molding.

6. The paneling unit of claim 1 wherein said relief channel extends along a portion of said side edge portion of said backing portion.

7. The paneling unit of claim 1 wherein said relief channel extends along the entire side edge portion of said backing portion.

8. The paneling unit of claim 1 wherein said relief channel has a width of about 0.05 inch.

9. The paneling unit of claim 1 wherein said relief channel has a depth of about 1.0 inch.

10. The paneling unit of claim 1 wherein said relief channel has a chamfer along a portion of its side edge.

11. A paneling unit comprising:

a siding portion having an attachment flange; and a backing portion secured to said siding portion, a surface of a side edge portion of said backing portion opposite an underside of said siding portion having a relief channel such that a gap is provided between said underside of said siding portion and said surface of said side edge portion of said backing portion, said relief channel extending from a bottom edge of said backing portion up to a point approximately where said backing portion is proximate to said attachment flange of said siding portion;

wherein said relief channel is adapted to receive a side edge portion of a siding portion of an adjacent paneling unit when installed such that said side edge portion of said siding portion of said adjacent paneling unit is situated between said underside of said siding portion of said paneling unit and said surface of said side edge portion of said backing portion of said paneling unit.

12. The paneling unit of claim 11 wherein said backing portion is comprised of a foamed plastic.

13. The paneling unit of claim 11 wherein said siding portion is a vinyl siding panel.

14. The paneling unit of claim 11 wherein said siding portion is comprised of a plastic composite including cellulosic filler.

15. The paneling unit of claim 11 wherein said relief channel is formed by a method selected from the group consisting of machining, extruding, and molding.

16. The paneling unit of claim 11 wherein said relief channel has a width of about 0.05 inch.

17. The paneling unit of claim 11 wherein said relief channel has a depth of about 1.0 inch.

18. The paneling unit of claim 11 wherein said relief channel has a chamfer along a portion of its side edge.

19. A paneling unit comprising:

a siding portion having an attachment flange; and a backing portion secured to said siding portion, a surface of a side edge portion of said backing portion opposite an underside of said siding portion having a relief channel such that a gap is provided between said underside of said siding portion and said surface of said side edge portion of said backing portion, said relief channel extending from a bottom edge of said backing portion up to a point approximately where said backing portion is proximate to said attachment flange of said siding portion, said relief channel having a width of about 0.05 inch and a depth of about 1.0 inch;

wherein said relief channel is adapted to receive a side edge portion of a siding portion of an adjacent paneling unit when installed such that said side edge portion of said siding portion of said adjacent paneling unit is situated between said underside of said siding portion of said paneling unit and said surface of said side edge portion of said backing portion of said paneling unit.

20. The paneling unit of claim 19 wherein said relief channel has a chamfer along a portion of its side edge.

* * * * *